US010653278B2

(12) United States Patent
Maercovich

(10) Patent No.: US 10,653,278 B2
(45) Date of Patent: May 19, 2020

(54) AUTOMATIC FOAM SOAP DISPENSER

(71) Applicant: Jorge Maercovich, Chatsworth, CA (US)

(72) Inventor: Jorge Maercovich, Chatsworth, CA (US)

( * ) Notice: Subject to any disclaimer, the term of this patent is extended or adjusted under 35 U.S.C. 154(b) by 0 days.

(21) Appl. No.: 16/293,603

(22) Filed: Mar. 5, 2019

(65) Prior Publication Data

US 2019/0191935 A1 Jun. 27, 2019

Related U.S. Application Data

(63) Continuation of application No. 14/810,443, filed on Jul. 27, 2015, now Pat. No. 10,349,786.

(51) Int. Cl.

| | |
|---|---|
| ***A47K 5/12*** | (2006.01) |
| ***A47K 5/14*** | (2006.01) |
| ***A47K 5/16*** | (2006.01) |

(52) U.S. Cl.

CPC ..... *A47K 5/1217* (2013.01); *A47K 5/1205* (2013.01); *A47K 5/1211* (2013.01); *A47K 5/14* (2013.01); *A47K 5/16* (2013.01); *A47K 2005/1218* (2013.01)

(58) Field of Classification Search

CPC .... A47K 2005/1218; A47K 5/14; A47K 5/16; A47K 5/1217; A47K 5/1205; A47K 5/1211

USPC ..... 222/52, 63, 333, 190, 504, 517, 410, 222/383.2–383.3

See application file for complete search history.

(56) References Cited

U.S. PATENT DOCUMENTS

| | | | | |
|---|---|---|---|---|
| 5,305,916 A * | 4/1994 | Suzuki | B65B 39/004 | 222/181.2 |
| 8,770,440 B2 * | 7/2014 | Lin | A47K 5/16 | 222/180 |
| 2011/0127290 A1 * | 6/2011 | Law | A47K 5/12 | 222/52 |

* cited by examiner

*Primary Examiner* — Vishal Pancholi
*Assistant Examiner* — Andrew P Bainbridge
(74) *Attorney, Agent, or Firm* — Raymond Y. Chan; David and Raymond Patent Firm

(57) ABSTRACT

An automatic foam soap dispenser includes a liquid soap dispenser, an activation unit, and an actuation unit. The liquid soap dispenser includes an outlet, a fluid reservoir for containing liquid soap, and a pump being depressed for dispensing the liquid soap in the fluid reservoir to the outlet. The activation unit includes a sensor for detecting a presence of a user of the liquid soap dispenser, and a motor having a transmission shaft, wherein the motor is activated by the sensor for generating a rotational power to the transmission shaft. The actuation unit includes a pressing member and a linkage system arranged to transmit the rotational power from the motor to a linear movement to the pressing member so as to drive the pressing member to depress the pump.

10 Claims, 7 Drawing Sheets

AUTOMATIC FOAM SOAP DISPENSER

CROSS REFERENCE OF RELATED APPLICATION

This is a Continuation application that claims the benefit of priority under 35 U.S.C.§ 120 to a non-provisional application, application Ser. No. 14/810,443, filed Jul. 27, 2015. The afore-mentioned patent application is hereby incorporated by reference in its entirety.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to the field of the field of soap dispensers, and more particularly to the field of automated soap dispensers.

Description of Related Arts

To improve the cleanliness within public restrooms as many devices as possible are provided an automated solution, and this is nowhere more evident than with the sink area. It makes the most sense that in the sink area a hand-free operation is utilized because those are some of the last things we touch in a public restroom. One of the most recent developments in this area are the automated hand soap dispensers. Using a sensor, the automated hand soap dispensers are able to sense when a hand is placed underneath the device and then a portion of the hand soap is automatically dispensed. The main object of this device is to not only prevent the spread of bacteria through initiating less equipment contact, but also to dispense a predetermined amount of soap to conserve the usage.

Additionally, the use of a foaming hand soap has been recently widely adopted by many public restrooms. The advantages of this foaming hand soap are that since solutions require water to be premixed into them less soap needs to be utilized allowing for a lower overall overhead. Also, since the solution comes out pre-lathered the user is able to spend less time attempting to achieve this same lather as with a thick liquid soap.

Current automated foam soap dispensers achieve this, but not without their disadvantages. Existing automated foam soap dispensers require a motorized actuation to depress the nozzle to dispense the foam soap and require additional mechanical work to pump the foam soap through a tube. This is due to the fact that the dispenser for the soap contains a nozzle that is set perpendicular to the central axis of the dispenser container. This requires a design for a conventional automated foam soap dispenser to include a large cumbersome motor able to fulfill this task. These large motors are very aesthetically unpleasing and force the automated foam soap dispensers to be mounted underneath the sink area of a restroom.

SUMMARY OF THE PRESENT INVENTION

The invention is advantageous in that it provides an improvement for an automatic foam soap dispenser that is more compact and simpler.

Another advantage of the invention is to provide an inline push bottom system that is able to actuate the pump nozzle of the foam soap dispenser.

Another advantage of the invention is to provide an inline push button system that is able to return the pump nozzle of the foam soap dispenser so its original position.

Another advantage of the invention is to provide more methods of mounting the automatic foam soap dispenser due to its more compact arrangement in comparison to the prior art.

Another advantage of the invention is to provide an inline dispenser nozzle for the dispenser whereby an additional motor is not required to pump the foam soap to the operator.

Another advantage of the invention is to provide an inline push button system that is able to translate the rotational movement of a motor to linear movement to actuate a link to pump the dispenser nozzle of the foam soap dispenser and return it to its original position in a single process.

Additional advantages and features of the invention will become apparent from the description which follows, and may be realized by means of the instrumentalities and combinations particular point out in the appended claims.

According to the present invention, the foregoing and other objects and advantages are attained by automatic foam soap dispenser.

In accordance with another aspect of the invention, the present invention comprises a foam soap dispenser further comprising a fluid reservoir, an output nozzle, an inlet tube, a liquid to foam soap system, and a mounting arrangement, a corresponding mounting arrangement, a motorized push button system further comprising a plurality of gears and linkages able to translate the rotational motion of a motor into an reciprocating linear movement, a sensor, a tubing arrangement to dispense the foam soap, a power supply, and a housing.

The present invention of an automatic foam soap dispenser improves upon the conventional art by utilizing a motorized inline push button system to actuate a single reciprocating linear movement to pump an inline dispenser nozzle for a foam soap dispenser and return it to its position. The present invention comprises a foam soap dispenser further comprising a container, an output nozzle, a liquid to foam soap conversion mechanism, and a mounting arrangement, a corresponding mounting arrangement, a motorized push button system further comprising a plurality of gears and linkages able to translate the rotational motion of a motor into an reciprocating linear movement, a sensor, a tubing arrangement to dispense the foam soap. The advantages are that since a single the dispenser nozzle is an inline with the direction of the fluid flow, any additional motors required to pump the foam soap to the user are unnecessary. This improvement in design allows the present to be more compact and simpler to use than the conventional art.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
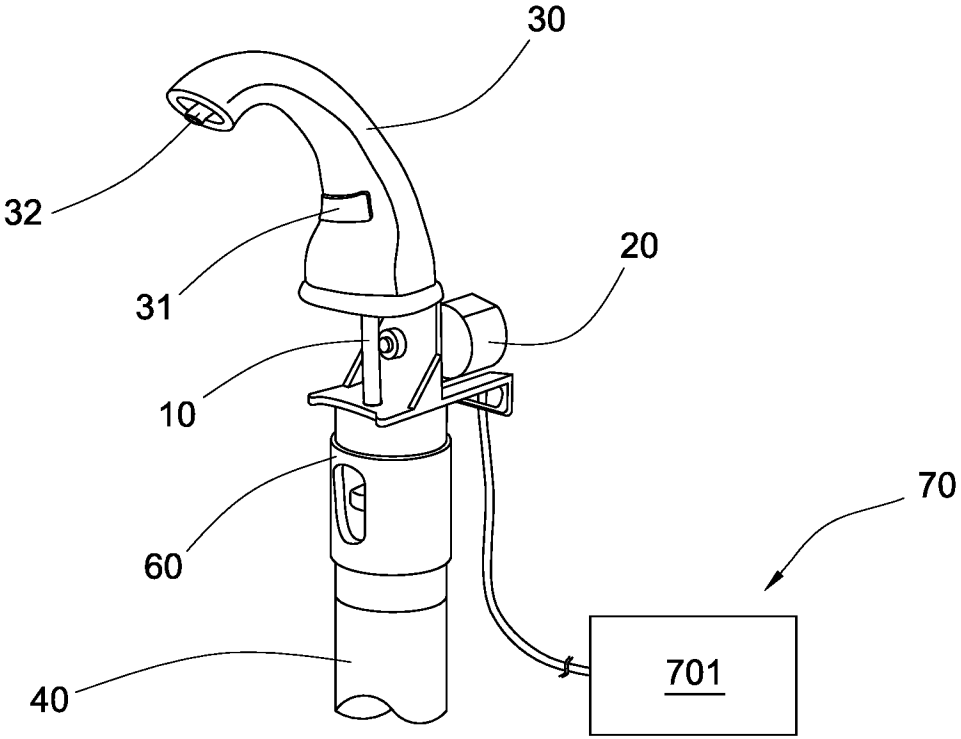
FIG. 1 is a perspective view of the automatic foam soap dispenser according to the preferred embodiment of the present invention.

FIG. 1 is a perspective view of the automatic foam soap dispenser in the preferred embodiment of the present invention. The exterior elements of the present invention of an automatic foam soap dispenser are comprised of a sensor 31, an outlet 32, and an exterior housing 30. In this present embodiment the exterior housing 30 is shaped as a curved body with a downward facing outlet 32 so that when the liquid soap 90 is dispensed, it is it done with little risk of getting on the operator's clothes. Contained within the exterior housing 30 is tubing 10 which connects the outlet 32 to the outlet nozzle 41 of the liquid soap dispenser 40. Since the tubing 10 that connects the outlet 32 with the outlet nozzle 41 of the liquid soap dispenser 40 is flexible, this exterior housing 30 can be embodied in a variety of shapes and the present embodiment of the exterior housing 30 is not meant to limit the design of this exterior housing 30.

The liquid soap dispenser 40 is further comprised of a pump 42, a pump cap 43, a fluid reservoir 44, and a liquid to foam system 45 that are mounted in an interior housing 60. The interior housing 60 allows all the elements of the liquid soap dispenser 40 to be retain in a proper orientation. The cavities provided by interior housing 60 allow each of the elements to be housed appropriately. The pump 42 and pump cap 43 are concentrically affixed to each other, wherein the pump 42 is able to move downward within the pump cap 43 a predetermined distance and is able to move back to its original upward position after it is released after being depressed, whereby an upward movement of the pump 42 within the pump cap 43 dispenses the liquid soap 90 from the fluid reservoir 44 as well as operates the liquid to foam system 45. Conversely a downward movement of the pump 42 within the pump cap 43 draws in the liquid soap 90 from the fluid reservoir 44 through an inlet tube 47 connected to the liquid to foam system 45, the pump 42, and the outlet nozzle 41 of the liquid soap dispenser 40. When the liquid soap 90 is drawn into the liquid to foam system 45 the depression of the pump 42 operates this liquid to foam system 45 and the output is a pre-lathered foam soap. The operational details of this liquid to foam system 45 are under protection of a prior art and thus are not necessary to be disclosed in this detailed description. Thus, the exterior elements directly connect to the liquid soap dispenser 40 via a tubing 10 which connects the outlet 32 of the present invention to the outlet nozzle 41 of the liquid soap dispenser 40.

The present invention of an automatic foam soap dispenser is able to automatically dispense a predetermined amount of liquid soap, such as pre-lathered soap, in the fluid reservoir 44 when the user triggers the sensor 31 that is located and permanently affixed on a surface facing the user of the exterior housing 30. The sensor 31 is electrically connected to the motor 20, and when the sensor 31 is triggered this activates the motor 20 to complete a predetermined function of rotating the linkage system 50 and thereby actuating the pump 42 of the liquid to foam system 45. Accordingly, the motor 20 is an electric motor. The operation of the motor 20 to generate a rotational power when the sensor 31 is triggered is the motor 20, which has a transmission shaft 21 rotates upon receiving signal from the sensor 31 which operates a linkage system 50. This linkage system 50 is able to translate the rotational movement of the transmission shaft 21 of the motor 20 into a linear movement to actuate the pump 42. The motor 20 and the sensor 31 are powered by a power source 70 which is embodied as a battery pack 701, but this power supply can be any source of appropriate voltage such as a wall socket. The motor 20 and sensor 31 are electrically connected to this battery pack 701 by a series of elongated conductive cables.

Figure 2:
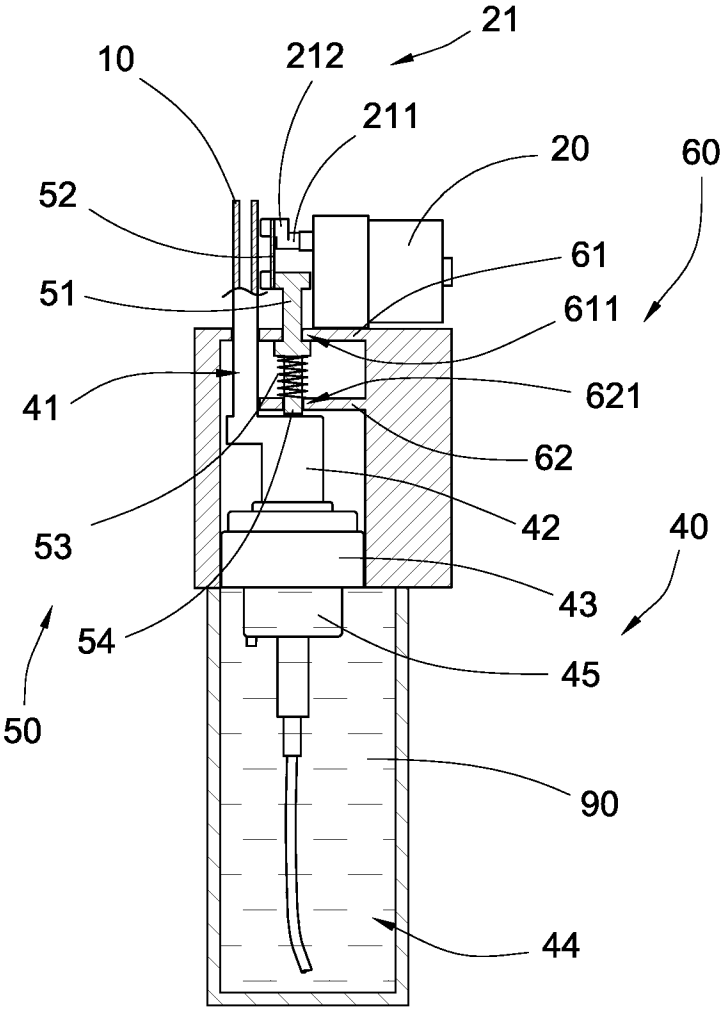
FIG. 2 is a schematic view of the automatic foam soap dispenser according to the preferred embodiment of the present invention, illustrating the pressing member at a normal position.

As shown in FIG. 2, the transmission shaft 21 has a motor extending portion 211 operatively extended from the motor 20 and a driving portion 212 eccentrically extended from the motor extending portion 211, such that when the motor extending portion 211 of the transmission shaft 21 is driven to rotate, the driving portion 212 of the transmission shaft 21 is driven to rotate about the motor extending portion 211 of the transmission shaft 21.

FIG. 2 is a schematic view of the automatic foam soap dispenser in the preferred embodiment of the present invention. This automatic foam soap dispenser comprises an actuation unit for depressing the pump 41. The actuation unit comprises a pressing to member 51 and the linkage system 50 and how the rotational movement of the motor 20 is translated into a reciprocating linear movement to the pressing member 51. The linkage system 50 is comprised of a driving member 52. The driving member 52 is connected to the transmission shaft 21 of the motor 20 at a point of rotation. Preferably, the transmission shaft 21 is not connected to the center of the driving member 52. In particular, one side of the driving member 52 is rotatably connected to the driving portion 212 of the transmission shaft 21 while an opposed side of the driving member 52 is rotatably connected to the pressing member 51 to transmit the rotational power from the motor 20. Therefore, when the transmission shaft 21 is rotated, the driving member 52 is driven to move downwardly so as to depress the pressing member 51.

Figure 3:
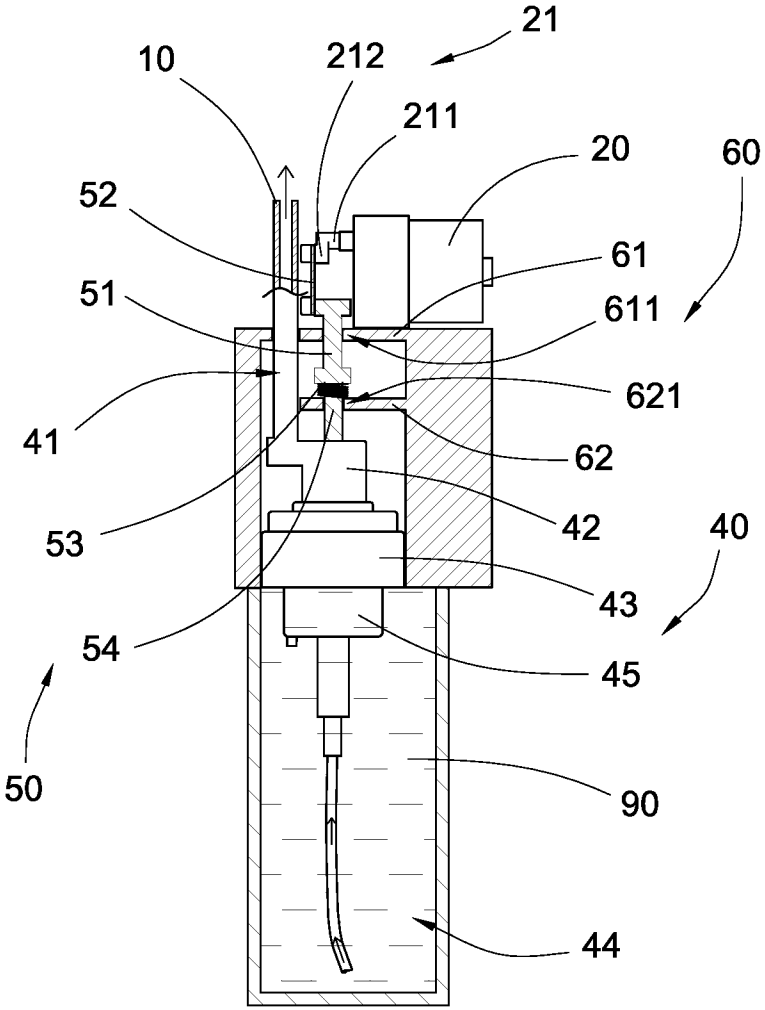
FIG. 3 is a schematic view of the automatic foam soap dispenser according to the preferred embodiment of the present invention, illustrating the pressing member at a depressed position.

As shown in FIG. 2, when the transmission shaft 21 is rotated at a position that the driving portion 212 of the transmission shaft 21 is located above the motor extending portion 211 of the transmission shaft 21, the pressing member 51 is not depressed. As shown in FIG. 3, when the transmission shaft 21 is rotated at a position that the driving portion 212 of the transmission shaft 21 is located below the motor extending portion 211 of the transmission shaft 21, the pressing member 51 is depressed. In other words, when the transmission shaft 21 is rotated in one single revolution, the driving portion 212 of the transmission shaft 21 is moved from the position above the motor extending portion 211 of the transmission shaft 21 to the position below the motor extending portion 211 of the transmission shaft 21 and is then moved back to the position above the motor extending portion 211 of the transmission shaft 21. As a result, the pressing member 51 is depressed by the driving member 52 is then moved back to its original position in response to the revolution of the transmission shaft 21.

It is worth mentioning that the number of rotation of the transmission shaft 21 can be selectively configured in response to one single activation of the sensor 31. For example, the sensor 31 is activated in presence of the user, the motor 20 is actuated to generate the rotational power for driving the transmission shaft 21 in two full revolutions. As a result, the pressing member 51 is depressed twice via the driving member 52 for dispensing the liquid soap twice.

The interior housing 60 comprises an upper platform 61 and a lower platform 62 horizontal and parallel to the upper platform 61. The motor 20 is supported on the upper platform 61 and the pump 42 is supported below the lower platform 62. The upper platform 61 has an upper guiding slot 611 formed thereon. The pressing member 51 is slidably extended through the upper guiding slot 611, such that the pressing member 51 is guided to move at the upper guiding slot 611 to depress the pump 42 below the upper platform 61. The lower platform 62 further has a lower guiding slot 621 coaxially aligned with the upper guiding slot 611, wherein the pressing member 51 is downwardly extended from the upper guiding slot 611 toward the lower guiding slot 621.

The linkage system 50 further comprises an extension member 54 extended from the pressing member 51 end-to-end to the top side of the pump 42, wherein when the pressing member 51 is moved downwardly, the extension member 54 is driven to push downwardly to depress the pump 42. Accordingly, the extension member 54 is an extension of the pressing member 51 to prolong the length of the pressing member 51 from the driving member 52 to the pump 42. Preferably, the extension member 54 has a T-shape, wherein a bottom end of the extension member 54 slidably extended through the lower guiding slot 621 of the lower platform 62. In other words, the extension member 54 is located below the upper platform 61 and is driven downwardly toward the lower platform 62.

The linkage system 50 further comprises a resilient element 53 coupled at the extension member 54 for applying a resilient force to the extension member 54 so as to push the extension member 54 upward to back to its original position. Accordingly, the resilient element 53 comprises a compression spring coaxially coupled at the extension member 54, wherein an upper end of the resilient element 53 is biased against the extension member 54 and a lower end of the resilient element 53 is biased against the lower platform 62. Therefore, when the extension member 54 is pressed downwardly, the resilient element 53 is compressed to store the resilient force, i.e. the compression spring force. When the transmission shaft 21 is rotated back to its original position, i.e. the pressing member 51 is moved upwardly, the resilient element 53 will push the extension member 54 upwardly back to its original position.

The operation of the automatic foam soap dispenser is that when the sensor 31 detects the presence of user, the sensor 31 will generate a first activating signal to activate the motor 20. The motor 20 will generate the rotational power to drive the transmission shaft 21 to rotate at least one revolution. The pressing member 51 is driven to move down to depress the pump 42 and is then moved back up to release the depression of the pump 42. Once the pump 42 is depressed, the liquid soap is pumped out from the fluid reservoir 44 to the outlet 32. Accordingly, through a predetermined setting, the sensor 31 will generate a second activating signal to stop the motor 20 generating the rotational power. Preferably, the setting of the automatic foam soap dispenser is to selectively set the activating time of the motor 20 and/or the number of revolution of the transmission shaft 21, so as to controllably actuate the number of depression of the pump 42.

Figure 4:
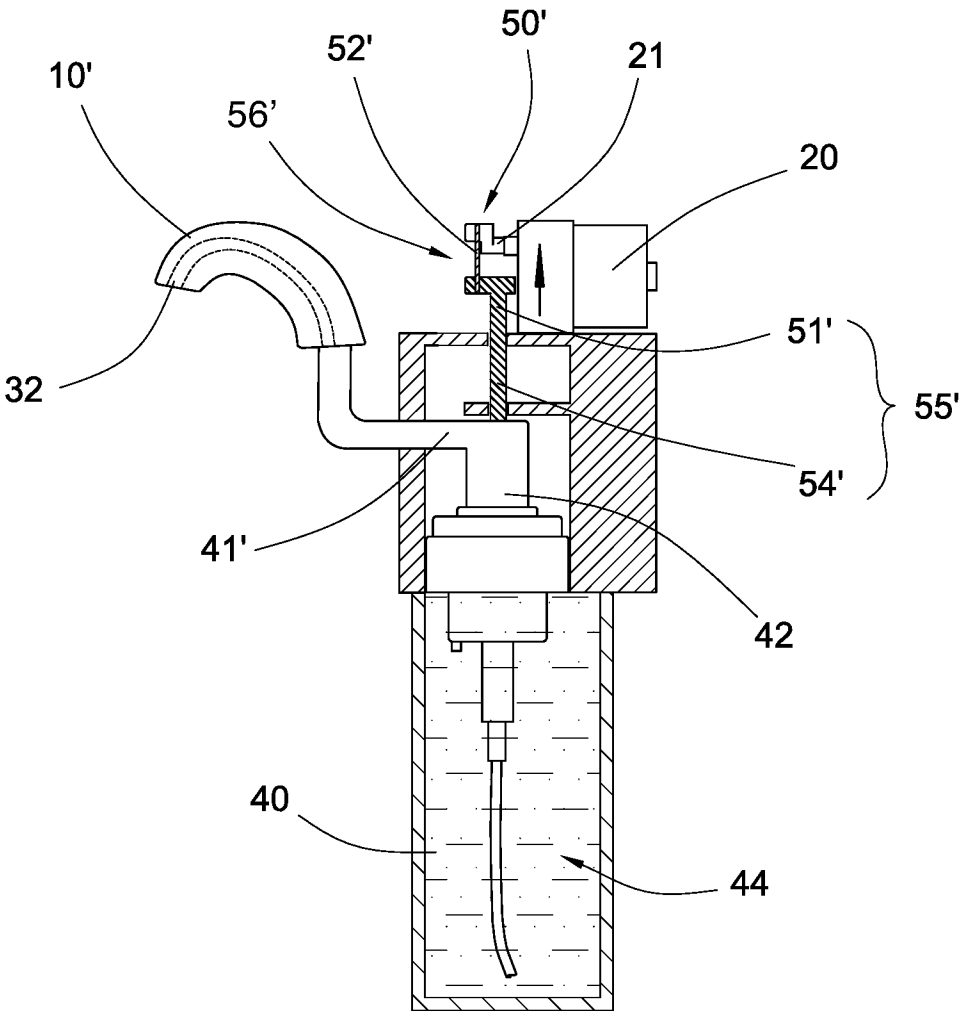
FIG. 4 illustrates a first alternative mode of the automatic foam soap dispenser according to the preferred embodiment of the present invention.

It is worth mentioning that the extension member 54' can be integrally extended from the pressing member 51' to form a one piece integrated member 55', such that the pressing member 51' can be directly press on the pump 42, as shown in FIG. 4.

FIG. 4 is a schematic view of the automatic foam soap dispenser in an additional embodiment of the present invention. In this present embodiment the present invention is able to be used with liquid soap dispensers 40 which have a perpendicular outlet nozzle 41'. Operationally this embodiment of an automatic foam soap dispenser is identical to the preferred embodiment of the present invention but the tubing 10' which connects the outlet nozzle 41 of the liquid soap dispenser 40 and the and the outlet 32 of the exterior housing 30 due to the flexible nature of the connecting tubing 10'.

Additionally in this alternative, the resilient element 53 is omitted and thus the present embodiment relies on the linkage system 50' to complete the full operation of the returning the pressing member 51 to its original position. The linkage system 50' in the current alternative of the present invention is comprised of a series of transmission gears 52', where on the last transmission gear 52' is a rotatably mounted horizontal linkage 56' that is connected to a pressing member 51'. Since the horizontal linkage 56' is rotatably mounted onto the last transmission gear 52', when the transmission gears 51' are rotated the horizontal linkage 56' is kept horizontal due to it being rotatably mounted. This causes the horizontal linkage 56' to displace a distance equal to twice the radius away the horizontal linkage 56' is mounted from the radius of the last transmission gear 52' it is mounted on. This distance is translated into a linear movement for the tip of the horizontal linkage 56'. If this tip of the horizontal linkage 56' is firmly secure with no slippage to the pressing member 51', this translates into a distance displaced by the pressing member 51' also. This operation allows the pressing member 51' to press the pump 42 for the liquid soap dispenser 40. The pump 42 and the horizontal linkage 56' are returned to their original positions when the transmission shaft 21' completes a full rotation and in turn does the last transmission gear 52'.

Figure 6:
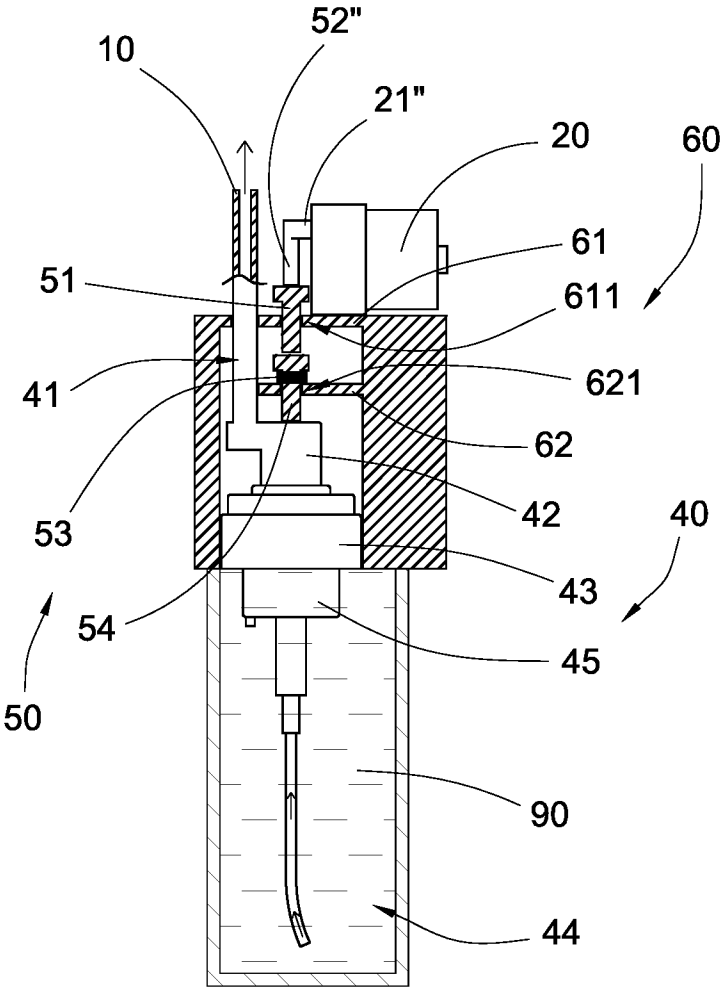
FIG. 6 illustrates the second alternative mode of the actuation unit of the automatic foam soap dispenser according to the preferred embodiment of the present invention, illustrating the pressing member at a depressed position.
Figure 5:
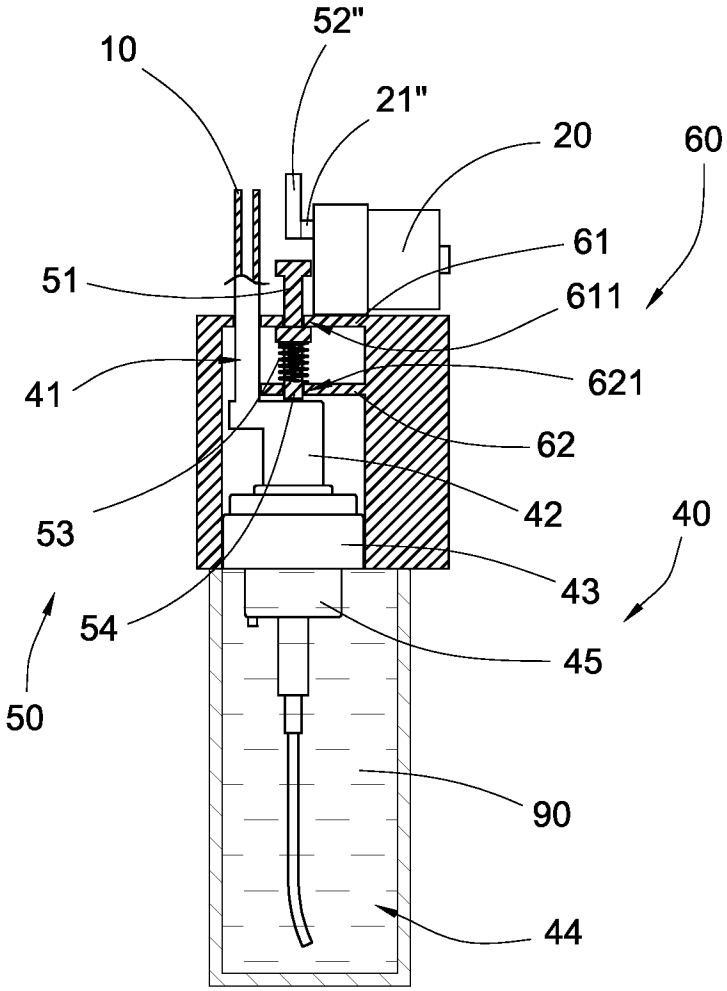
FIG. 5 illustrates a second alternative mode of the actuation unit of the automatic foam soap dispenser according to the preferred embodiment of the present invention, illustrating the pressing member at a normal position.
Figure 7:
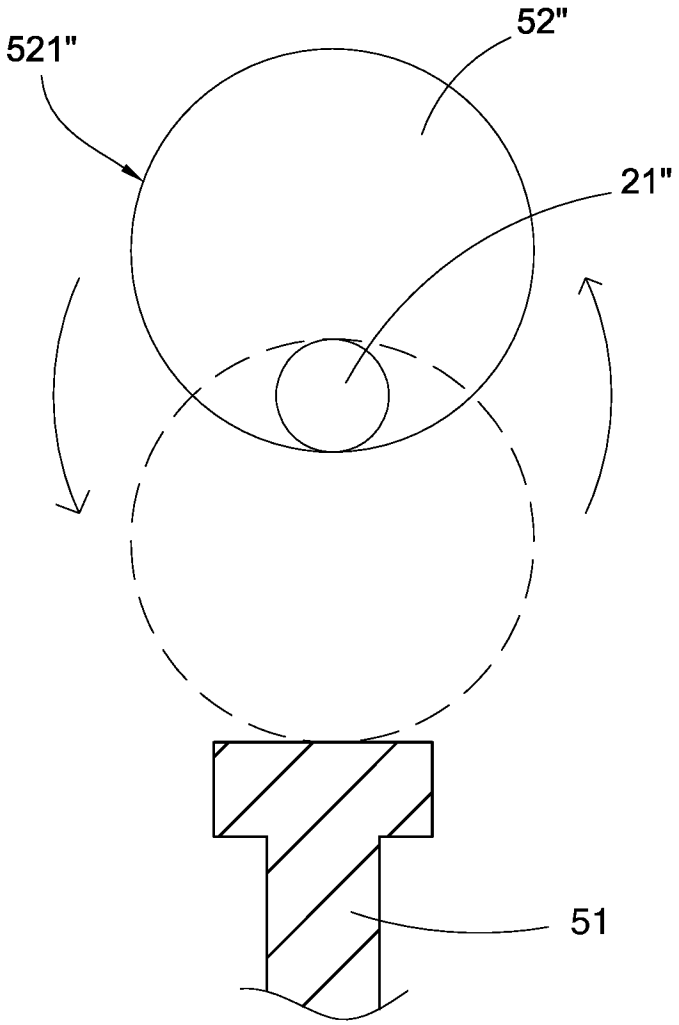
FIG. 7 illustrates the second alternative mode of driving unit being driven to rotate by the transmission shaft to press on the pressing member according to the preferred embodiment of the present invention.

FIGS. 5 to 7 illustrate another alternative mode of the linkage system 50", wherein the driving member 52" can be embodied as a flat circular element, such as a cam, wherein a rounded apex point is gradually realized at a distal position from the center of rotation. In particular, the transmission shaft 21" is an elongated shaft and is coupled at the peripheral portion of the driving member 52". In operation the pressing member 51 is kept in constant contact with the extension member 54 by means of a retention spring 53. When the driving member 52" is rotated via the transmission shaft 21" of motor 20, this causes the pressing member 51 to constantly trace the circumferential surface 521" of the driving member 52". This tracing of the circumferential surface 521" causes the rotational movement of the transmission shaft 21" to be translates into a linear movement of the pressing member 51. When the transmission shaft 21 is rotated this causes a reciprocating motion in the pressing member 51, and a single rotation of the driving member 52" will cause a complete reciprocating cycle of the pressing member 51. This reciprocating movement of the pressing member allows it to engage the pump 42 of the liquid soap dispenser 40 as detailed in the previous figure. The pressing member 51 is held in place and prevented from dislodging from being in surface contact by the interior housing 60.

Figure 8:
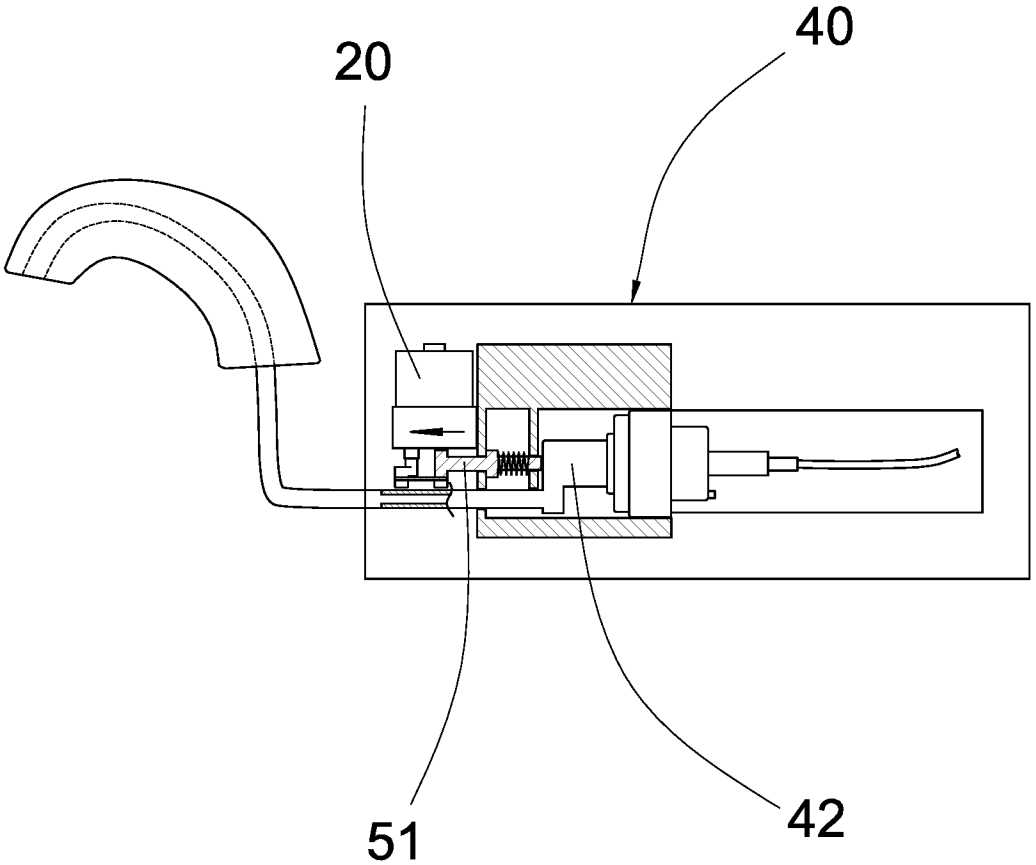
FIG. 8 is an operational view of an additional mounting method the automatic foam soap dispenser according to the preferred embodiment of the present invention.

FIG. 8 is an operational view of an additional mounting method of the automatic foam soap dispenser in the preferred embodiment of the present invention. In this preferred embodiment of the present invention, since only a single motor 20 is required to provide the full operational movement of the pressing member 51 to actuate the pump 42 of the liquid soap dispenser 40 the present invention is now more compact and simpler than the conventional art. This allows for a more variety of mounting methods that take advantage of this compact nature. In this present embodiment the automatic foam soap dispenser is able to be mounted horizontally with the entire device able to lie on top of a surface rather than have to be mounted between the table layer of a sink. This mounting method allows for the device to be more easily refilled with liquid soap because an operator doesn't have to lift the entire device or go underneath the sink to access the liquid soap dispenser. Also the fact that the foam soap dispenser is able to lie on top of a sink surface allows for the present invention to be easily used with all sink types.

Figure 9:
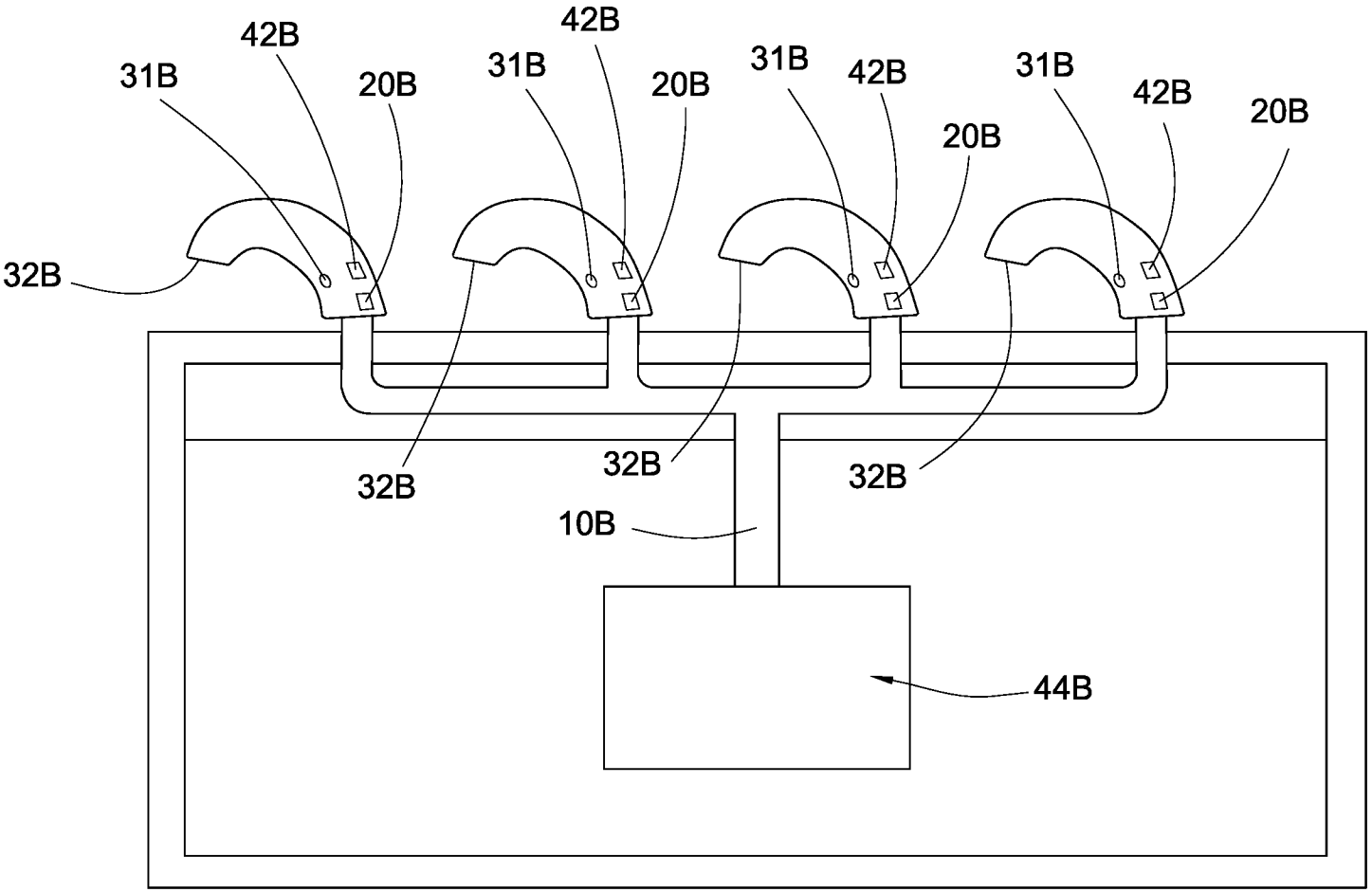
FIG. 9 is a schematic view of the automatic foam soap dispenser in an additional embodiment of the present invention, illustrating a plurality of outlets linked to a singular fluid reservoir.

FIG. 9 is an operational view of an additional embodiment of the automatic foam soap dispenser in an additional embodiment of the present invention. In this present embodiment, the sensor 31B, the pump 42B and the motor 20B are provided in a singular structure arrangement and are used to supply the foam soap to a plurality of outlets 32B. These outlets 32B are connected by a network of tubing 10B that connect the singular structure arrangement between the singular fluid reservoir 44 and the plurality of outlets 32B. This arrangement is advantageous for public restrooms with multiple sinks, thereby cutting down the costs of having to install multiple automatic foam soap dispensers.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic foam soap dispensing system, comprising:

a liquid soap dispenser comprising an outlet, a fluid reservoir for containing liquid soap, a pump operatively coupled to said fluid reservoir, and a liquid to foam system operatively coupled to said pump, wherein said pump is actuated for dispensing the liquid soap in said fluid reservoir to said outlet while said liquid to foam system makes the liquid soap in foam form;

an activation means which comprises a sensor for detecting a presence of a user of said liquid soap dispenser, and a motor which comprises a transmission shaft, wherein said motor is activated by said sensor for generating a rotational power to said transmission shaft; and an actuation means which comprises a pressing member and a linkage system operatively linked between said transmission shaft and said pressing member, wherein said linkage system comprises an extension member extended from said pressing member to said pump and a resilient element coupled at said extension member for applying a resilient force to said extension member, wherein said linkage system is arranged to transmit said rotational power from said motor to a linear movement to said pressing member so as to drive said pressing member to depress said pump so as to draw in the liquid soap by a first movement of said pump, wherein a second movement of said pump dispenses the liquid soap from said fluid reservoir and operates said liquid to foam system, wherein said linkage system comprises a driving member having one side rotatably coupled to said transmission shaft and an opposed side rotatably coupled to said pressing member, such that when said transmission shaft is rotated, said driving member is moved downwardly to drive said pressing member to depress said pump.

2. The automatic foam soap dispensing system, as recited in claim 1, wherein said transmission shaft has a motor extending portion operatively extended from said motor and a driving portion eccentrically extended from said motor extending portion, wherein said driving portion of said transmission shaft is rotatably coupled to said driving member.

3. An automatic foam soap dispensing system, comprising:

a liquid soap dispenser comprising an outlet, a fluid reservoir for containing liquid soap, a pump operatively coupled to said fluid reservoir, and a liquid to foam system operatively coupled to said pump, wherein said pump is actuated for dispensing the liquid soap in said fluid reservoir to said outlet while said liquid to foam system makes the liquid soap in foam form;

an activation means which comprises a sensor for detecting a presence of a user of said liquid soap dispenser, and a motor which comprises a transmission shaft, wherein said motor is activated by said sensor for generating a rotational power to said transmission shaft;

an actuation means which comprises a pressing member and a linkage system operatively linked between said transmission shaft and said pressing member, wherein said linkage system comprises an extension member extended from said pressing member to said pump and a resilient element coupled at said extension member for applying a resilient force to said extension member, wherein said linkage system is arranged to transmit said rotational power from said motor to a linear movement to said pressing member so as to drive said pressing member to depress said pump so as to draw in the liquid soap by a first movement of said pump, wherein a second movement of said pump dispenses the liquid soap from said fluid reservoir and operates said liquid to foam system; and an interior housing which comprises an upper platform having an upper guiding slot, wherein said motor is supported on said upper platform and said pressing member is slidably extended through said upper guiding slot to depress said pump below said upper platform.

4. The automatic foam soap dispensing system, as recited in claim 3, wherein said linkage system further comprises an extension member extended from said pressing member end-to-end to a top side of said pump, wherein when said pressing member is moved downwardly, said extension member is driven to push downwardly to depress said pump.

5. The automatic foam soap dispensing system, as recited in claim 4, wherein said interior housing further comprises a lower platform having a lower guiding slot coaxially aligned with said upper guiding slot, wherein said extension member is slidably extended through said lower guiding slot to said top side of said pump.

6. The automatic foam soap dispensing system, as recited in claim 5, wherein said linkage system further comprises a resilient element coupled at said extension member for applying a resilient force to said extension member, wherein one end of said resilient element is biased against said extension member and an opposed end of said resilient element is biased against said lower platform.

7. An automatic foam soap dispensing system, comprising:

a liquid soap dispenser comprising an outlet, a fluid reservoir for containing liquid soap, a pump operatively coupled to said fluid reservoir, and a liquid to foam system operatively coupled to said pump, wherein said pump is actuated for dispensing the liquid soap in said fluid reservoir to said outlet while said liquid to foam system makes the liquid soap in foam form;

an activation means which comprises a sensor for detecting a presence of a user of said liquid soap dispenser, and a motor which comprises a transmission shaft, wherein said motor is activated by said sensor for generating a rotational power to said transmission shaft; and an actuation means which comprises a pressing member and a linkage system operatively linked between said transmission shaft and said pressing member, wherein said linkage system comprises an extension member extended from said pressing member to said pump and a resilient element coupled at said extension member for applying a resilient force to said extension member, wherein said linkage system is arranged to transmit said rotational power from said motor to a linear movement to said pressing member so as to drive said pressing member to depress said pump so as to draw in the liquid soap by a first movement of said pump, wherein a second movement of said pump dispenses the liquid soap from said fluid reservoir and operates said liquid to foam system, wherein said pump is actuated in an up-and-down movement for dispensing the liquid soap in said fluid reservoir, wherein said pressing member is downwardly extended to said pump, wherein said pressing member is driven to actuate said pump in said up-and-down movement, wherein said driving member has one side rotatably coupled to said transmission shaft and an opposed side rotatably coupled to said pressing member, such that when said transmission shaft is rotated, said driving member is moved downwardly to drive said pressing member to depress said pump, wherein said transmission shaft has a motor extending portion operatively extended from said motor and a driving portion eccentrically extended from said motor extending portion, wherein said driving portion of said transmission shaft is rotatably coupled to said driving member.

8. A method of dispensing foam soap by a liquid soap dispenser, comprising the steps of:

(a) detecting a presence of a user of said liquid soap dispenser by a sensor;

(b) activating a motor by said sensor for generating a rotational power to a transmission shaft;

(c) transmitting said rotational power from said motor to a linear movement via a driving member; and (d) actuating a pressing member with said linear movement to depress a pump of said liquid soap dispenser for dispensing liquid soap in a fluid reservoir to an outlet while a liquid to foam system operatively coupled to said pump makes the liquid soap to foam form, wherein said step (c) further comprises a step of rotatably coupling one side of said driving member to said transmission shaft and rotatably coupling an opposed side of said driving member to said pressing member, such that said transmission shaft is rotated, said driving member is moved downwardly to drive said pressing member to depress said pump.

9. The method, as recited in claim 8, wherein said step (c) further comprises a step of configuring said transmission shaft to have a motor extending portion operatively extended from said motor and a driving portion eccentrically extended from said motor extending portion, wherein said driving portion of said transmission shaft is rotatably coupled to said driving member.

10. A method of dispensing foam soap by a liquid soap dispenser, comprising the steps of:

(a) detecting a presence of a user of said liquid soap dispenser by a sensor;

(b) activating a motor by said sensor for generating a rotational power to a transmission shaft;

(c) transmitting said rotational power from said motor to a linear movement via a driving member;

(d) actuating a pressing member with said linear movement to depress a pump of said liquid soap dispenser for dispensing liquid soap in a fluid reservoir to an outlet while a liquid to foam system operatively coupled to said pump makes the liquid soap to foam form; and (e) providing an upper platform having an upper guiding slot, wherein said motor is supported on said upper platform and said pressing member is slidably extended through said upper guiding slot to depress said pump below said upper platform.

* * * * *